US007493718B2

(12) United States Patent
Görzen

(10) Patent No.: US 7,493,718 B2
(45) Date of Patent: Feb. 24, 2009

(54) RIFLE WITH SHOULDER SUPPORT

(75) Inventor: Anatol Görzen, Kirchlengern (DE)

(73) Assignee: Steinkamp Maschinenbau GmbH & Co. KG, Espelkamp (DE)

( * ) Notice: Subject to any disclaimer, the term of this patent is extended or adjusted under 35 U.S.C. 154(b) by 184 days.

(21) Appl. No.: 11/456,266

(22) Filed: Jul. 10, 2006

(65) Prior Publication Data

US 2008/0005951 A1 Jan. 10, 2008

(51) Int. Cl.
*F41C 23/22* (2006.01)
*F41A 3/60* (2006.01)
*F41C 23/00* (2006.01)

(52) U.S. Cl. ..... 42/74; 42/42.02; 42/42.03

(58) Field of Classification Search ..... 42/40, 42/42.02, 42.03, 72, 73, 74, 75.03, 90, 71.01
See application file for complete search history.

(56) References Cited

U.S. PATENT DOCUMENTS

| | | | | | |
|---|---|---|---|---|---|
| 993,175 | A * | 5/1911 | Knuetgen | 89/126 |
| 2,293,128 | A * | 8/1942 | Fortin | 42/72 |
| 2,400,349 | A * | 5/1946 | Haberstump | 42/72 |
| 2,405,758 | A * | 8/1946 | Sampson | 42/72 |
| 2,424,944 | A * | 7/1947 | Patchett | 42/72 |
| 3,369,316 | A * | 2/1968 | Miller | 42/72 |
| 3,618,249 | A * | 11/1971 | Grandy | 42/73 |
| 3,766,677 | A * | 10/1973 | Waddell | 42/75.04 |
| 3,782,019 | A * | 1/1974 | Venturini | 42/72 |
| 3,798,819 | A * | 3/1974 | Hillberg | 42/72 |
| 3,817,148 | A * | 6/1974 | Schirneker | 89/155 |
| 3,950,875 | A * | 4/1976 | Hirschfeld | 42/42.01 |
| 4,199,886 | A * | 4/1980 | Deuring | 42/44 |
| 4,271,623 | A * | 6/1981 | Beretta | 42/72 |
| 4,299,046 | A * | 11/1981 | Atchisson | 42/75.04 |
| 4,383,384 | A * | 5/1983 | Fox | 42/72 |
| 4,489,515 | A * | 12/1984 | Numbers | 42/70.01 |
| 4,513,523 | A * | 4/1985 | Gal | 42/72 |
| 4,640,036 | A * | 2/1987 | Gal | 42/72 |
| 4,718,186 | A * | 1/1988 | Mattarelli | 42/75.04 |
| 4,735,007 | A * | 4/1988 | Gal | 42/72 |
| 4,766,800 | A * | 8/1988 | Miller et al. | 89/33.02 |
| 4,788,785 | A * | 12/1988 | White | 42/72 |
| 5,209,215 | A * | 5/1993 | Morrison | 124/25 |
| 6,374,719 | B1 * | 4/2002 | Phillips | 89/34 |
| 6,526,683 | B1 * | 3/2003 | Crandall | 42/40 |
| 6,874,618 | B1 * | 4/2005 | Cragg | 206/3 |
| 6,901,691 | B1 * | 6/2005 | Little | 42/118 |
| 2002/0007580 | A1 * | 1/2002 | Randall et al. | 42/76.01 |
| 2005/0115140 | A1 * | 6/2005 | Little | 42/118 |

* cited by examiner

*Primary Examiner*—Bret Hayes
(74) *Attorney, Agent, or Firm*—Gudrun E. Huckett

(57) ABSTRACT

A rifle has a shoulder support and at least one barrel connected to the shoulder support. A trigger is provided and a chamber is arranged behind the trigger when looking in a direction from a front end of the barrel toward the shoulder support. A movable breechblock has a closed position in which the chamber is closed off. At least one firing pin for firing a cartridge inserted into the chamber when the trigger is triggered is provided. A coupling mechanism connects the shoulder support or a swivel arm to the breechblock. The breechblock is movable by a pivot movement of the shoulder support or the swivel arm transmitted by the coupling mechanism. An axis of rotation of the shoulder support or the swivel arm is arranged within a space delimited by the breechblock and the trigger viewed across a length of the rifle.

21 Claims, 10 Drawing Sheets

RIFLE WITH SHOULDER SUPPORT

BACKGROUND OF THE INVENTION

The present invention relates to a rifle having a shoulder support, at least one barrel, a trigger, a chamber behind the trigger, a movable breechblock, and a firing pin.

Rifles are known in numerous prior art configurations. Because of the long barrel defining its configuration, rifles enable the firing of high precision shots even across long distances but they have the disadvantage that they are comparatively heavy, bulky and awkward to handle. Because of the shoulder support arranged at the rear of the barrel, such rifles have usually a length of more than one meter. The great length makes precise aiming more difficult when shooting freehand because of the leverage effect.

In the prior art, so-called bullpup rifles are known where the barrel and the action are moved toward the rear of the stock in order to shorten the length of the rifle as a whole. In these firearms the trigger is approximately arranged at the central third of the total length of the weapon. Because the barrel extends approximately to the rear end of the stock, rifle lengths of approximately only 80 cm can be achieved.

In bullpup rifles there is however the problem of selecting a proper type of breechblock that is best suited to block the barrel.

It is an object of the present invention to provide a rifle where easy handling of the rifle is not impaired by projecting breechblock levers, whose length should be as short as possible, and whose operation and handling should be as simple as possible.

SUMMARY OF THE INVENTION

In accordance with the present invention, this is achieved in that the breechblock can be movable with regard to its position by a pivot movement of the shoulder support and/or of a swivel arm enabled by means of a coupling mechanism and the axis of rotation of the shoulder support or of the swivel arm is arranged in a space that, viewed across the length of the rifle, is delimited by the breechblock and the trigger.

By embodying the shoulder support and/or the swivel arm to be pivotable, the shoulder support and/or the swivel arm is easily accessible and can be easily actuated in order to actuate by the pivot movement the breechblock and to open and close in this way the chamber. When the shoulder support and/or the swivel arm act as a pivot lever, other types of levers for operating the breechblock system are no longer needed. In this way, there are no disturbing levers or grips projecting laterally from the firearm like those of known breechblock mechanisms.

By arranging the axis of rotation of the shoulder support and/or of the swivel arm in a space that, viewed across the length of the rifle, is delimited by the breechblock and the trigger, the entire length of the rifle remains very short. Those parts that are pivotably designed can also be short and lightweight. The location where the axis of rotation is arranged can be selected anywhere across the height of the rifle as is deemed expedient within the space delimited with regard to its length. The proposed coupling mechanism between the shoulder support or the swivel arm and the movable breechblock can be comprised of a simple slotted hole guide or a coupling link and is therefore easily actuatable, requires no or low maintenance, is robust and has only a minimal weight.

The combination of the features according to the invention enables a very short rifle that has a normal barrel length and still has a total length that is less than one meter. The rifle can be of a very lightweight construction and, because no disturbing components project laterally or to the rear, can be transported and stowed easily.

In order to make the rifle particularly lightweight, no magazine is provided. After opening the breechblock, the cartridge is inserted manually into the barrel, the barrel is blocked again by the breechblock, and the rifle is ready to be fired.

According to one embodiment of the invention, the rifle has two barrels arranged over and under. In this configuration, the breechblock can be configured as a unit for blocking the chambers of both barrels. Of course, the breechblock can block in the case of a single barrel the chamber of that single barrel. In the double barreled rifle, one barrel can be used for shotgun cartridges (shotgun pellets) and the other barrel for rifle cartridges (bullets). With such a configuration, the rifle can be used, for example, for military purposes as pilot's rifle for emergency situations. Also, the rifle can be used very well for general hunting purposes because, despite its minimal weight and compact dimensions, is enables precise shots even at great distances and it can be easily transported or carried across great distances.

DESCRIPTION OF THE PREFERRED EMBODIMENTS

Figure 1:
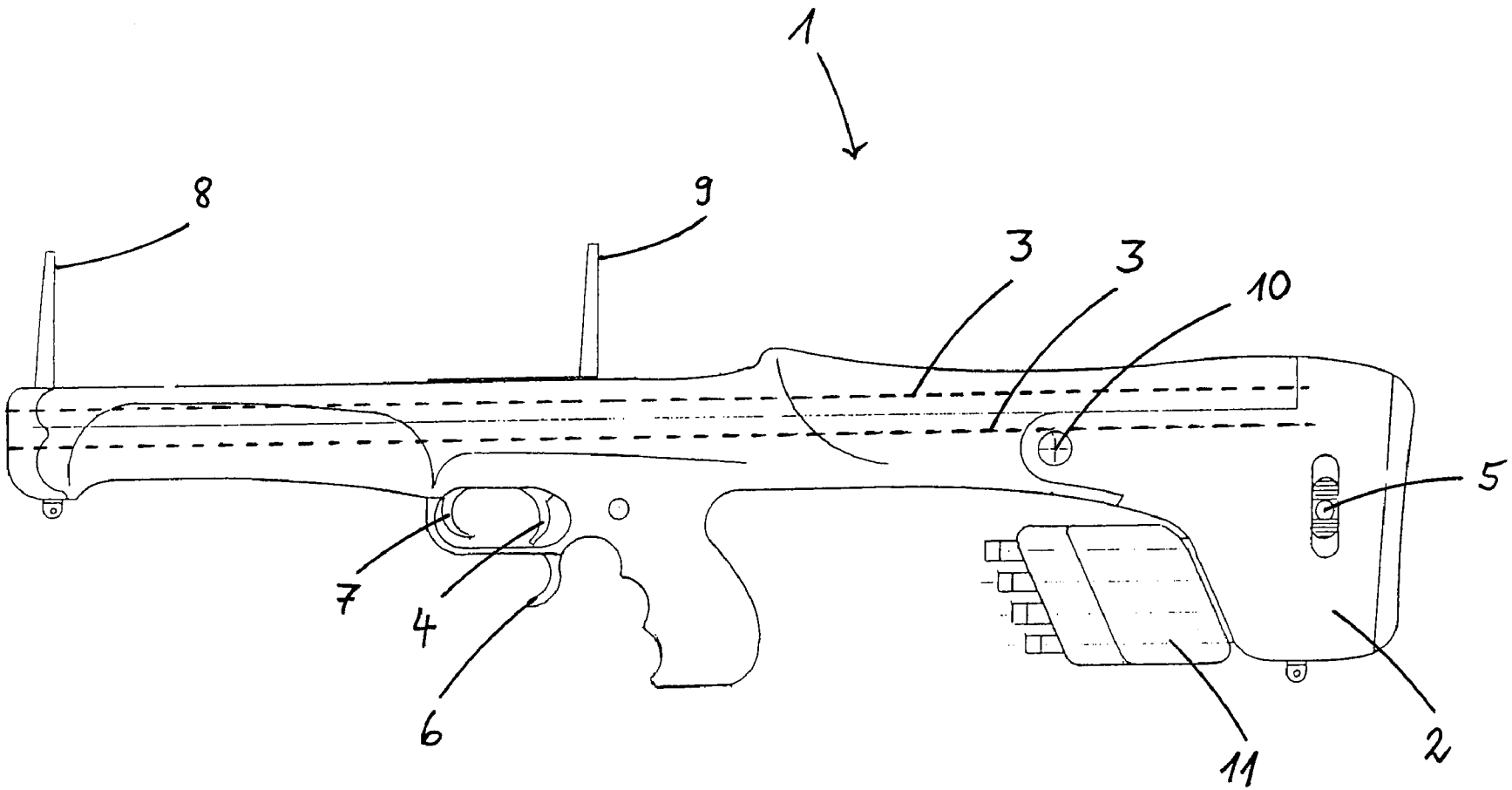
FIG. 1 is a side view of a rifle according to the invention.

FIG. 1 shows the rifle according to the invention in a side view. In the rear area of the rifle 1 a shoulder support 2 is provided. The invention will be explained with the aid of an embodiment that has two over and under barrels 3 indicated in FIG. 1 by dashed lines. The invention is however also suitable for rifles that have only one barrel or several barrels, for example also barrels arranged side by side. Approximately at the central third of the total length of the rifle 1 there is the trigger 4. In the shoulder support 2 there is a switch 5 with which the movement of the trigger bolt can be switched alternatingly to the top or bottom barrel 3. Below the trigger 4 there is a release lever 6 that can lock the trigger mechanism of the rifle and, depending on the design of the rifle, also the movement of the breechblock. Opposite the trigger 4, a coking lever 7 is provided with which the trigger mechanism can be cocked. On the topside of the rifle 1 a fold-out front sight 8 as well as of fold-out notch sight 9 are provided as an example of a sight. As a modification of the illustrated embodiment, these sights can also be designed to be fixed, or a telescopic sight can be used.

Figure 2:
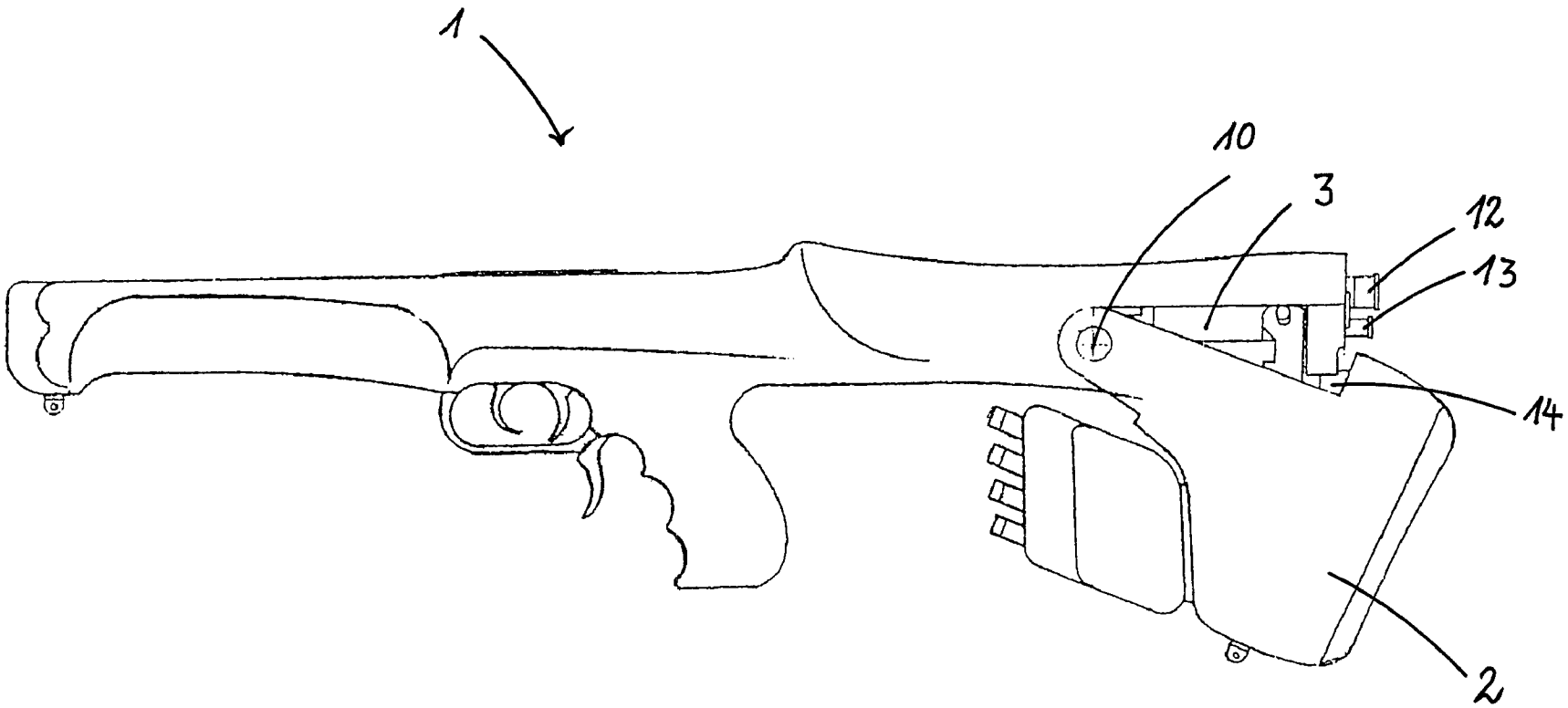
FIG. 2 shows the rifle of FIG. 1 with the shoulder support folded down.

The shoulder support 2 is pivotable about axis of rotation 10. The axis of rotation 10 can be arranged in deviation from the illustrated embodiment at a different location within the space that is delimited in the longitudinal direction of the rifle 1 by the trigger 4 and the breechblock 14. At the bottom side of the shoulder support 2 there is a storage device 11 provided in which as a magazine several cartridges and/or other small parts such as a knife, a compass, a radio, food concentrates or the like can be provided. A storage device 11 for small parts can also be located in the shoulder support 2 or in or at the forward stock or central stock or at a different location of the shoulder support 2. The storage device 11 can be designed to be removable or detachable.

in FIG. 2, the rifle illustrated in FIG. 1 is shown with the shoulder support 2 folded down. In the open position of the shoulder support 2 the cartridges that have been partially inserted into the respective barrel 3 can be seen. In the illustrated example, a shotgun cartridge 12 is loaded in the top barrel 3 and a rifle cartridge 13 is inserted in the bottom barrel. The shoulder support 2 is folded downwardly to such an extent that the breechblock 14 releases the cartridge chambers of the barrels 3 completely so that they are easily accessible.

Figure 3:
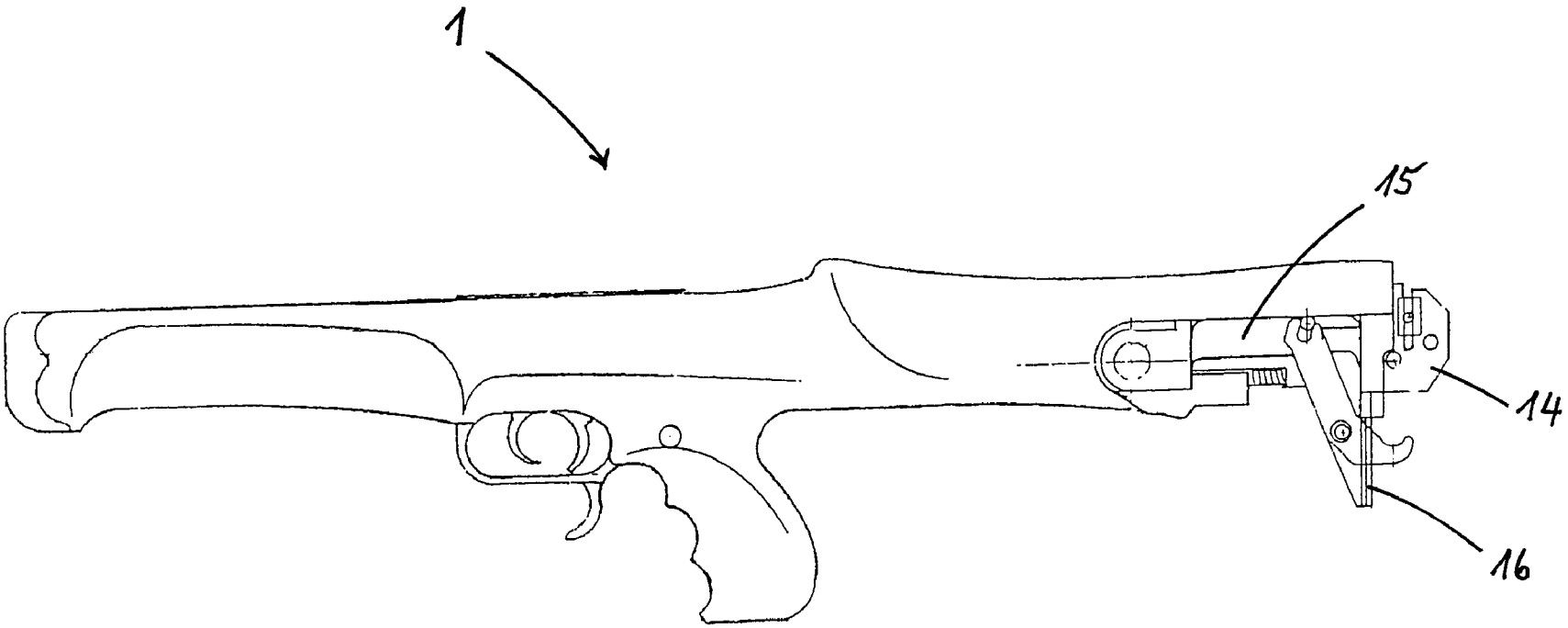
FIG. 3 shows the rifle of FIG. 1 with the shoulder support removed.

In FIG. 3, the shotgun or rifle 1 with the shoulder support 2 having been removed is illustrated. In this illustration, the breechblock 14 can be seen well at the rear end of the rifle 1. The breechblock 14 is in the closed position in this illustration. The barrels 3 are secured by a breechblock housing 15 on which the breechblock 14 is secured so as to be movable. The breechblock 14 doses in the illustrated closed position the cartridge chamber 18 of both barrels 3.

Figure 4:
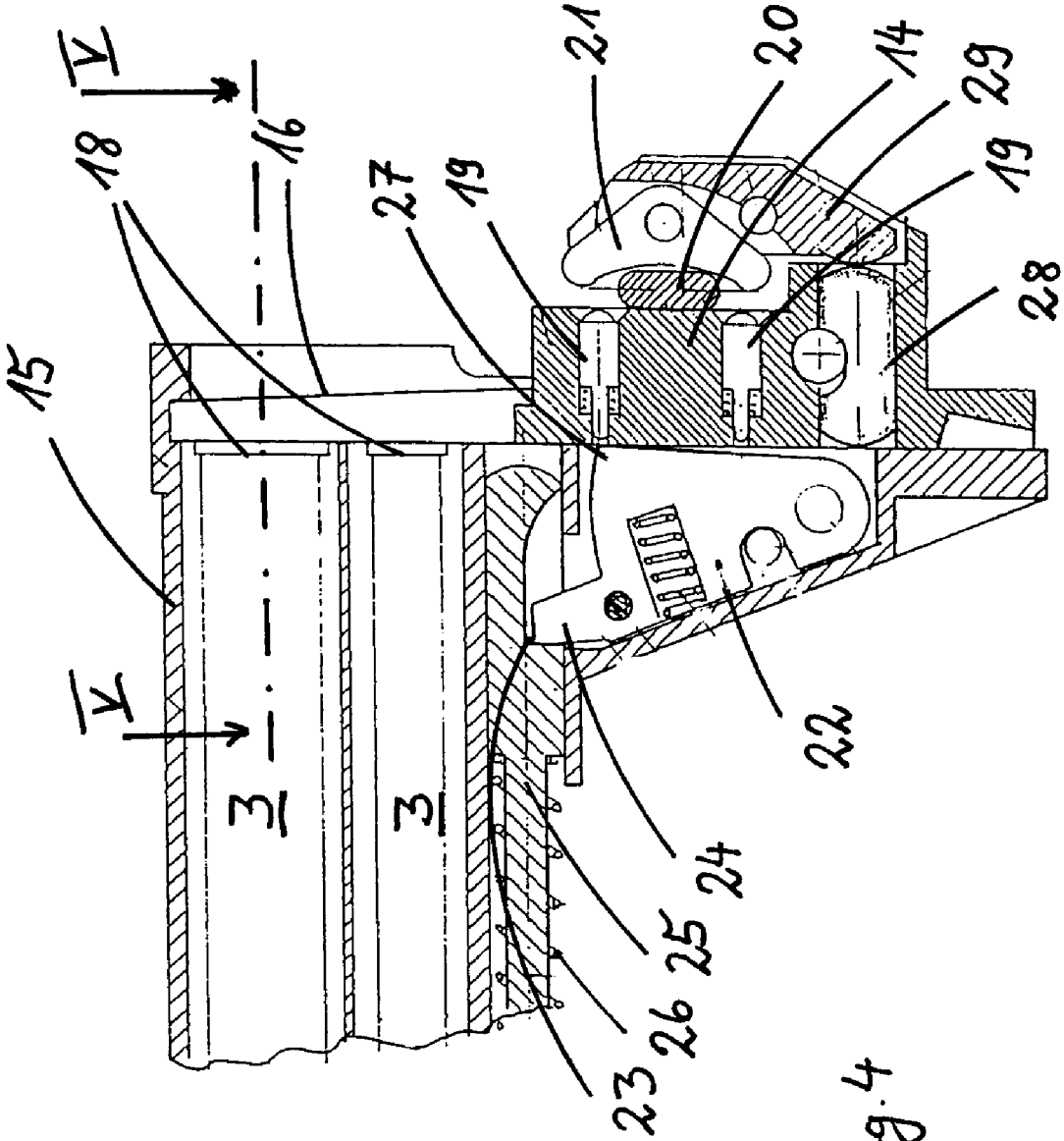
FIG. 4 is a detail of the breechblock mechanism.

In FIG. 4, the breechblock system is shown in a detailed view. In FIG. 4, the breechblock 14 is in its lower open position. In this view, the guide 16 can be seen along which the breechblock 14 is movable. The breechblock 14 is movable in particular for opening and/or closing the cartridge chamber 18 in a movement direction which is essentially perpendicular to the longitudinal axis of the barrels 3. Viewed across the length of the rifle 1, the movable arrangement of the breechblock 14 requires no additional length because the length of the space that is required for realizing the movability of the breechblock 14 is essentially only the height of the breechblock 14. The space must only ensure movability of the breechblock 14 in the downward vertical direction; this space can be realized by a swivel or pivot movement of the shoulder support 20 or of the swivel arm 50 about the axis of rotation 10 that is essentially transverse to the longitudinal axis of the barrel 3, i.e. is extends horizontally.

The guide 16 can have an undercut 17 which engages a portion of the breechblock 14 or the guide 16 has a dovetail shaped or T-groove shaped cross-section so that the breechblock 14 during its movement is safely guided. The guide 16 is so solidly constructed that the explosion forces acting on the breechblock when firing a shot are received by the guide and diverted into the breechblock housing 15. Preferably, the guide 16 is designed such that the breechblock 14 is secured positively in its closed position so that, in this way, the explosion forces are directly transmitted onto the guide 16 and the breechblock housing 15. At the rear part of the barrels 3 there are chambers 18 into which the appropriate cartridge is inserted.

In FIG. 4, the firing pins 19 provided within the breechblock 14 as well as the mechanism for their actuation can be seen very well. In the case of a single barrel firearm, the mechanism for actuating only a single firing pin 19 can be arranged in the breechblock 14. In the closed position of the breechblock 14, the firing pins 19 transmit a firing movement of the rocker 21 onto the bottom of the cartridge within the chamber 18. As can be seen in the illustration of FIG. 4, the movement of the rocker 21 can be blocked by the blocking mechanism comprising a movable block 20. In the neutral position illustrated in FIG. 4, the rocker 21 is blocked by the block 20 and can neither move to reach the upper or the lower firing pin 19. When the block 20 is moved to the top, the lower end of the rocker 21 moves against the lower firing pin 19. In the upper position of the block 20 it is thus only possible to fire the cartridge within the lower barrel because the upper barrel 3 is blocked by the block 20. When the block 20 is in the downwardly moved position, the lower firing pin 19 is blocked and the upper end of the rocker 21 is moved against the upper firing pin 19. Upon actuation of the trigger, the triggered movement is transmitted through the rocker 21 onto the upper firing pin 19 and the cartridge within the top barrel 3 is fired. The spatial position of the block 20 can be changed by actuation of the switch 5. When moving the switch 5 to a center position, the firearm is "on safe", and a movement of the switch 5 to an upper position or a lower position enables firing of top barrel or bottom barrel 3, respectively.

In the lower area of the breechblock housing 15 a further block 22 is provided. In the position illustrated in FIG. 4, the block 22 blocks with its locking nose 24 a recess or cutout 23 in the trigger bolt 25 so that the trigger bolt 25 is blocked by the locking nose 24 in the illustrated position. Since the breechblock 14 is in the lower open position, a movement of the trigger bolt 25 cannot be transmitted onto any of the firing pins 19. As soon as the breechblock 14 has been moved out of its closed position into an open position, it is no longer possible to fire a shot with the rifle 1. Because of the special configuration of the mechanism of the movable breechblock 14 the rifle 1 is thus automatically on safe as soon as the breechblock 14 is no longer in its blocking position.

Figure 5:
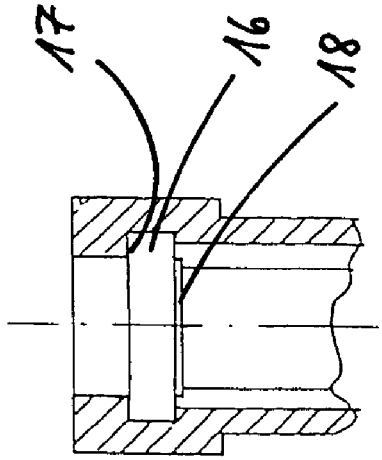
FIG. 5 is a section view a long section line V-V of FIG. 4.

In FIG. 5 a section view along section line V-V of FIG. 4 is shown. The breechblock housing 15 which forms the guide 16 is illustrated in which the breechblock 14 is movably supported. Also, the undercut 17 is shown which enables excellent transfer of the explosion forces onto the breechblock housing 15.

Figure 6:
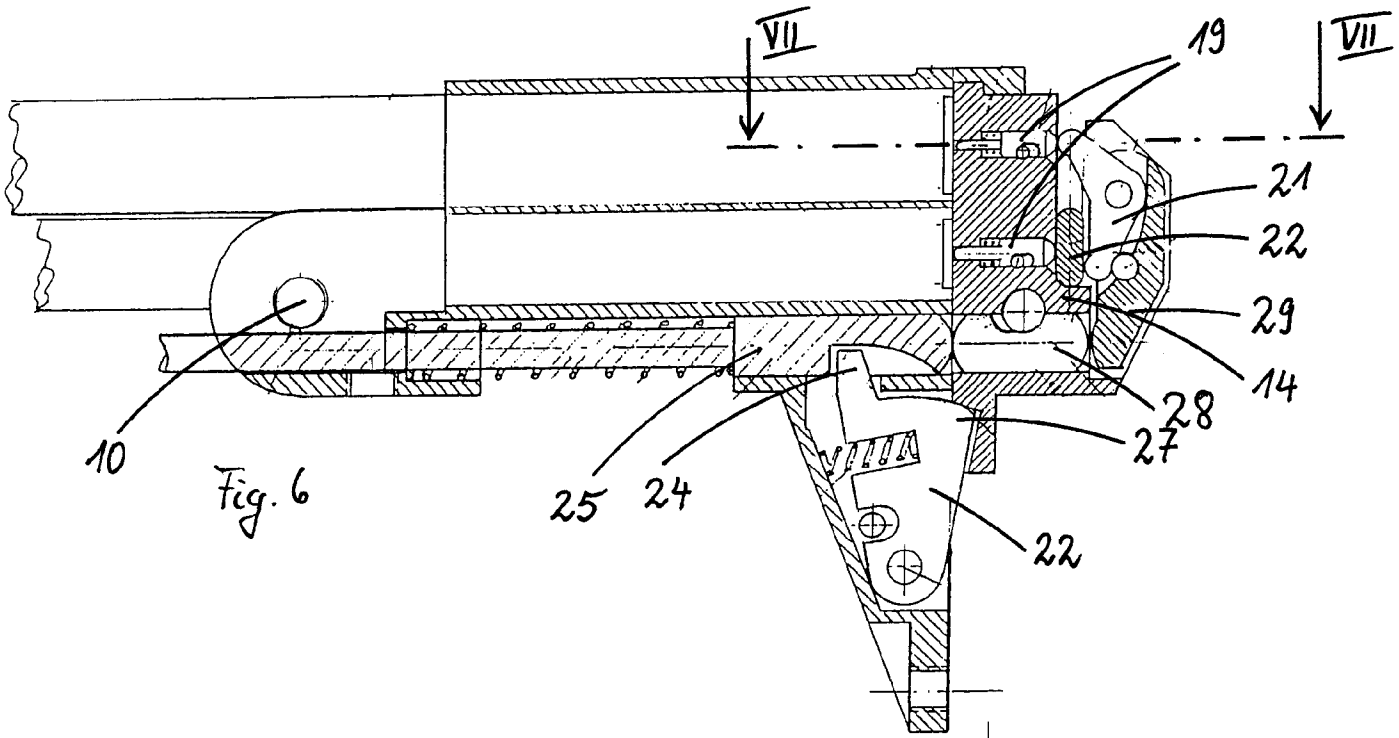
FIG. 6 is a detail view of the rifle with the breechblock mechanism in the blocking position.

FIG. 6 shows a section view of the rifle 1 in which the breechblock 14 is in its closed position. The block 20 is in its lower position so that a movement of the trigger bolt 25 can be transmitted onto the firing pin 19 of the top barrel 3. The block 22 is in a changed position relative to the position illustrated in FIG. 4 in which changed position it blocks with its projection 27 the breechblock 14 in its dosed position. At the same time, the locking nose 24 is moved to the rear so that the trigger bolt 25, driven by the spring 26, can transmit a trigger movement onto the slide bolt 28 that, in turn, transmits this movement onto the rocking lever 29 that actuates the rocker 21. By means of the aforementioned actuating elements, upon actuation of the trigger 4 the movement of the trigger bolt 25 that is pretensioned by the spring 26 is transmitted onto a cartridge within the barrel 3.

Figure 7:
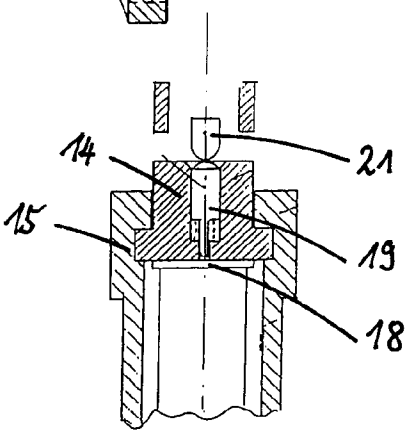
FIG. 7 is a section view along section line VII-VII of FIG. 6.

In FIG. 7, a section view along the line VII-VII of FIG. 6 is illustrated. It can be seen in comparison to FIG. 5 that the breechblock 14 closes off the chamber 18 and is secured in its closed position by the breechblock housing 15 and the undercut 17.

Figure 8:
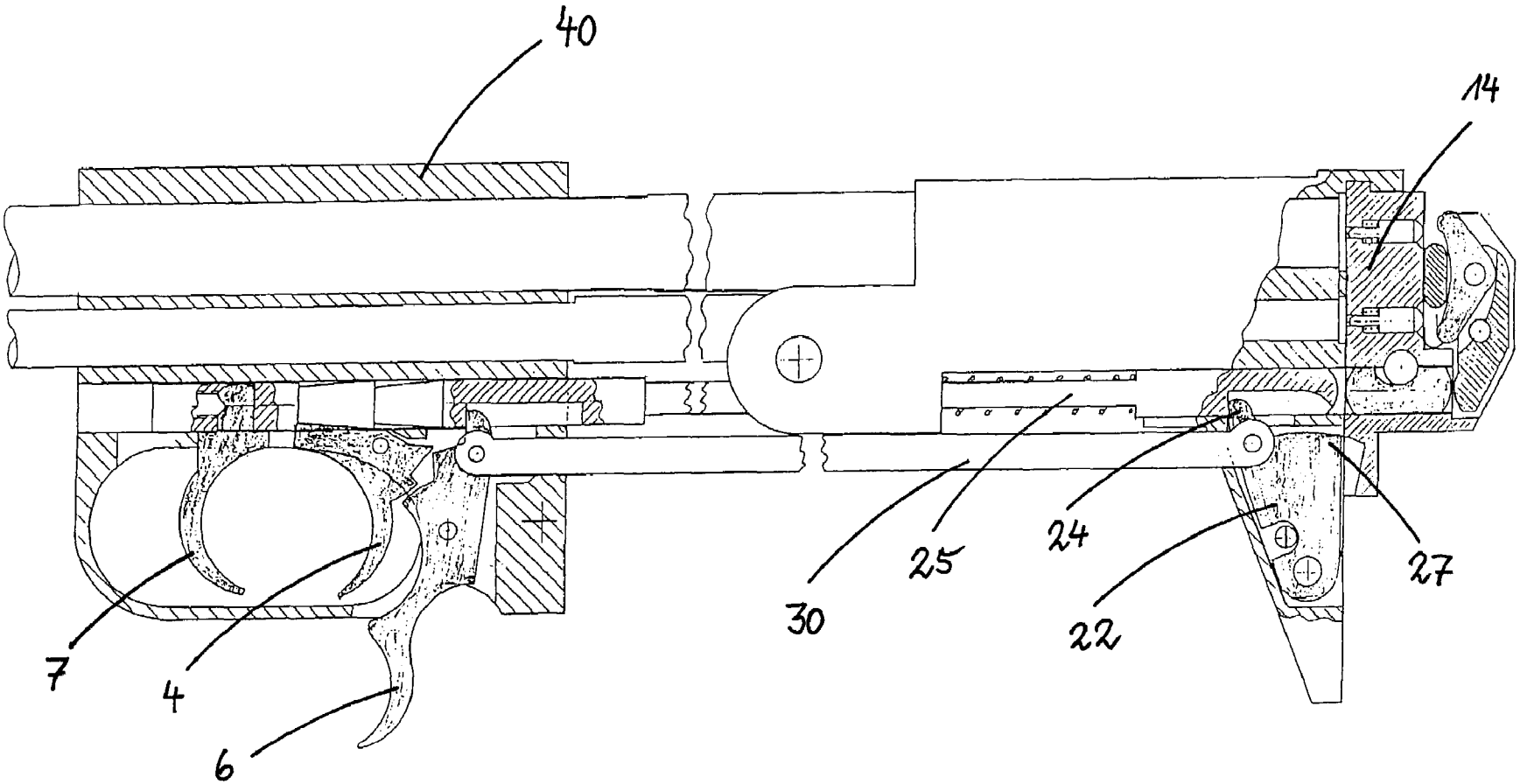
FIG. 8 is a view of the trigger and blocking mechanisms in the safe position.

In FIG. 8, a view of the secured trigger and blocking mechanisms can be seen. The release lever 6 is shown in a position into which it has been moved from its neutral position wherein by means of the locking rod 30 the actuation movement of the release lever 6 has been transmitted onto the block 22. When the release lever 6 is pulled out of its neutral position, the locking nose 24 of the block 22 is moved into its locking position and the breechblock 14 is movable across the projection 27. When the locking lever 6 is moved back into its neutral position, the locking rod 30 transmits this movement onto the block 22 in such a way that the projection 27 locks the breechblock 14 in the closed position and the locking nose 24 releases the trigger bolt 25. When the breechblock 14 is not in its closed position, the release lever 6 cannot be moved back into the neutral position because a movement of the projection 27 is blocked by the breechblock 14.

In FIG. 8 it is shown that the mechanism of the trigger 4 is attached to a frame 40 that is fixedly connected to at least one of the barrels 3. In order to prevent bending of a barrel 3 that occurs as a result of heat-caused expansion of the other barrel 3, for example, by firing a shot with this barrel 3, the frame 40 should be preferably fixedly connected to only one of the two barrels. For example, the frame 40 can be fixedly connected to the top barrel 3 and the frame 40 has a passage through which the bottom barrel 3 is then freely movable in the barrel direction. The reverse arrangement is possible also.

Figure 9:
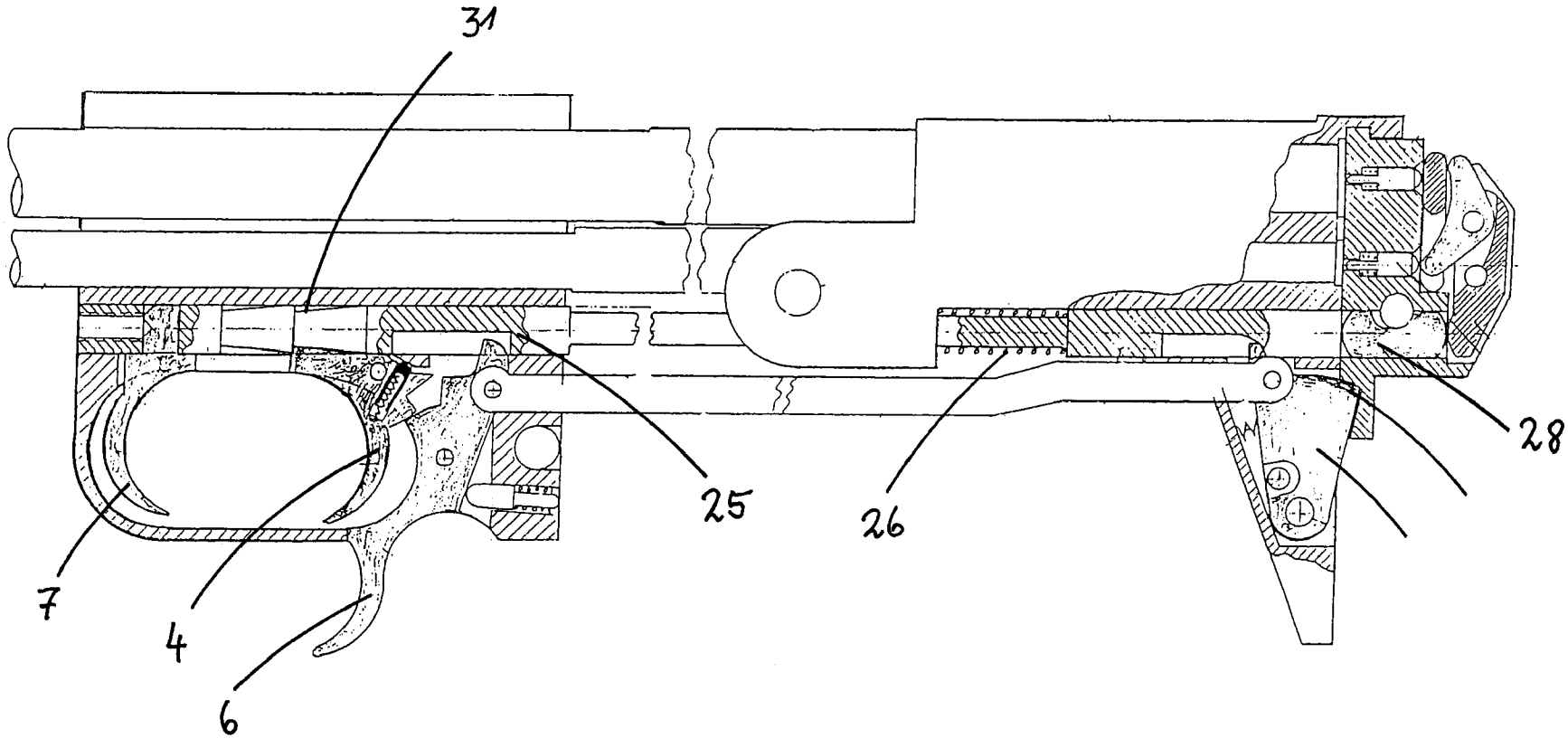
FIG. 9 is a view of the cocked trigger and blocking mechanisms.

In FIG. 9, a view of the trigger and blocking mechanisms is illustrated in which the cocking lever 7 has been moved into its cocked position. The trigger bolt 25 has notches 31 in the area of the trigger 4; a projection of the trigger 4 is forced by spring force into the notches 31 when the trigger bolt 25 has been cocked far enough against the spring 26. When the trigger 4 is pulled down against the spring force to such an extent that the projection is pulled out of the engaged notch 31 in the trigger bolt 25, the trigger bolt 25 is driven by the spring 26 in the direction of the slide bolt 28 and the cartridge is fired once the movement of the trigger bolt 25 has been transmitted onto the cartridge bottom.

Figure 10:
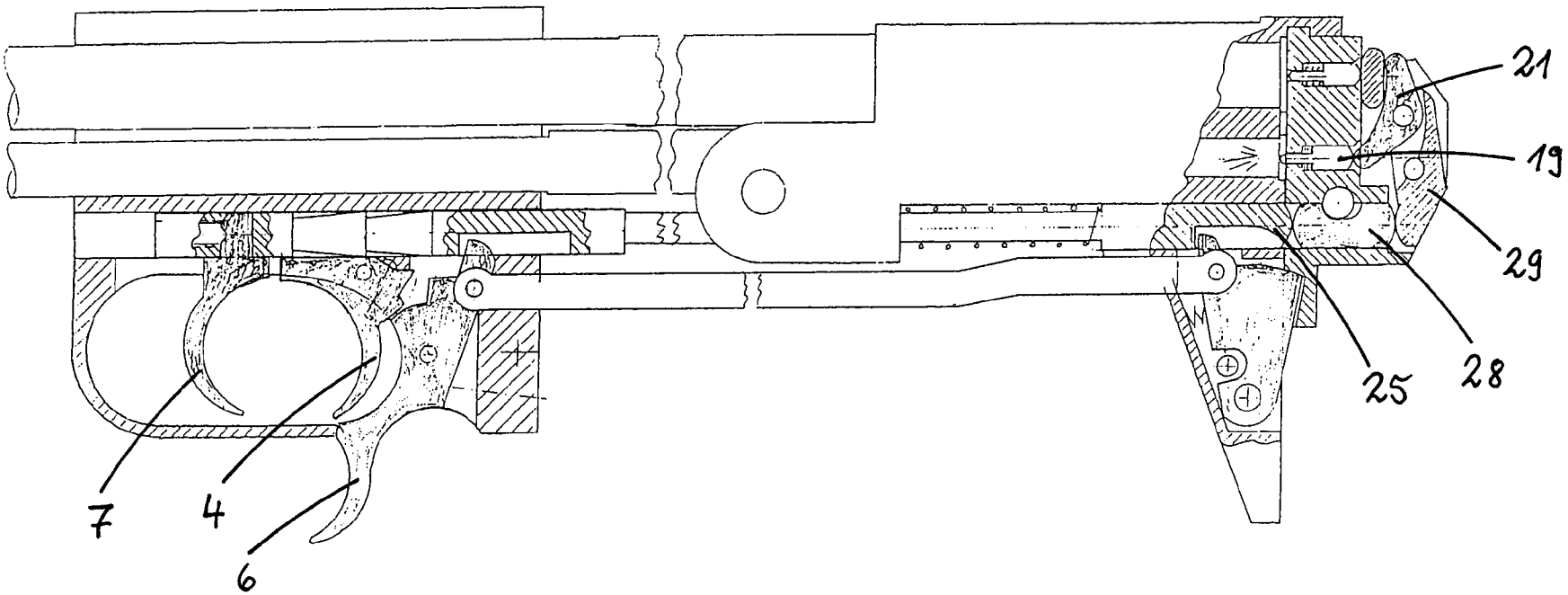
FIG. 10 is a view of the uncocked trigger and blocking mechanisms.

In FIG. 10, the trigger and blocking mechanisms are illustrated in a view in which the cocking lever 7 is again completely uncocked. The trigger bolt 25 reaches with its leading end into the recess of the breechblock 14 in which the slide bolt 28 is located. The slide bolt 28 is moved by the trigger bolt 25 so far to the rear that it actuates the rocking lever 29 which, in turn, transmits this movement onto the rocker 21 that acts onto the lower firing pin 19 and causes firing of the cartridge in the lower barrel 3.

Figure 11:
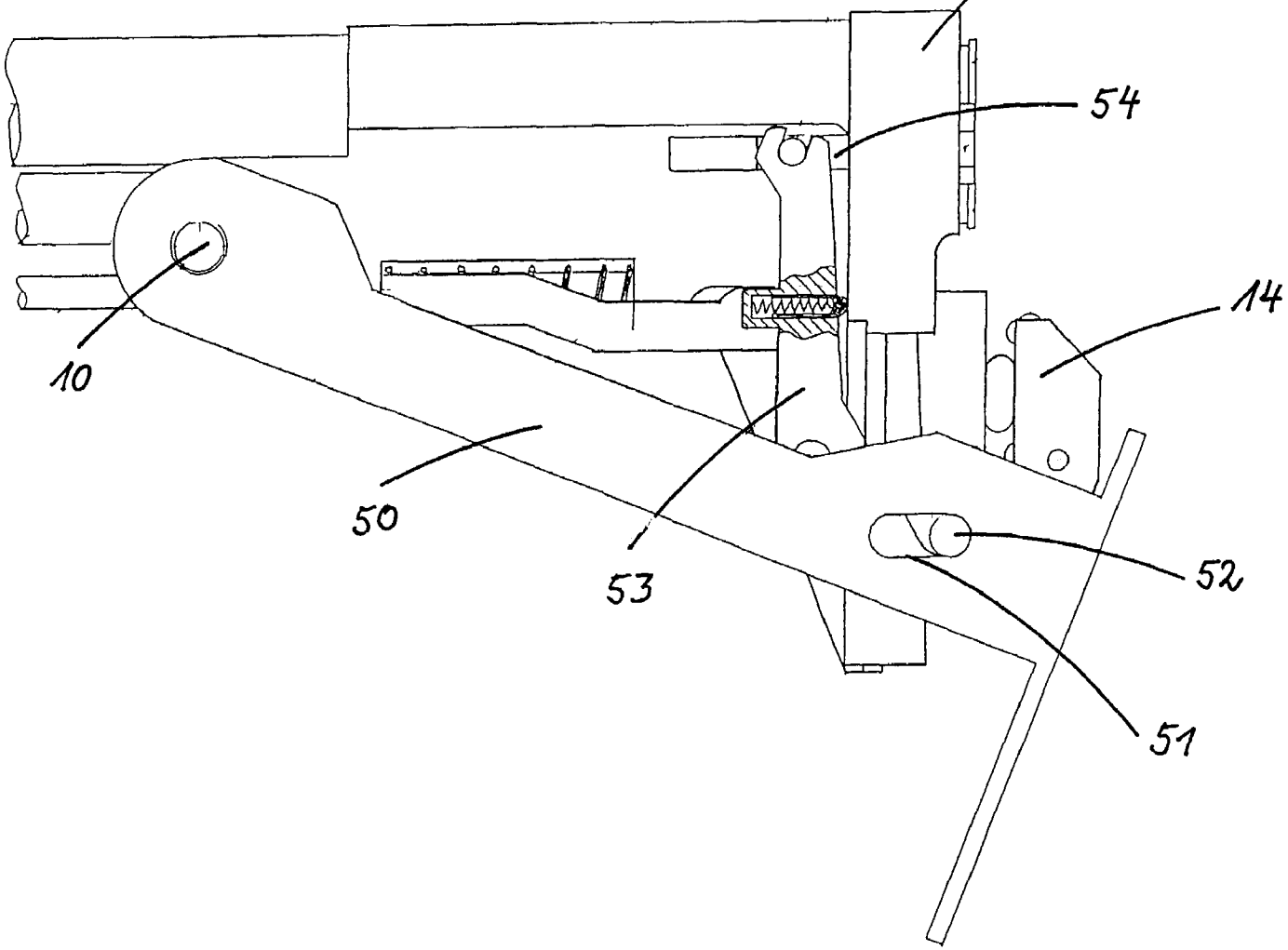
FIG. 11 is a view of the coupling mechanism in an open position.

In FIG. 11 an embodiment of the coupling mechanism in an open position is illustrated. The swivel arm 50—that can form the shoulder support 2, can be connected to the shoulder support, or can be embodied as a separate element—is pivotable about axis of rotation 10 and is shown in a position in which it is pivoted downwardly. The shoulder support 2 is not illustrated in FIG. 11. It is not important for the invention whether the shoulder support 2 itself is pivotably supported about pivot axis 10 or whether the shoulder support 2 has a separate swivel arm 50 that can be pivoted together with the shoulder support 2 or independent therefrom. It is an important feature of the invention that the shoulder support 2 and/or the swivel arm 50 are rotationally movable and that this rotational movement is transmitted by the coupling mechanism into a sliding movement of the breechblock 14. The swivel arm 50 is designed and arranged such that it does not project past the outer contour of the shoulder support 2. The swivel arm 50 can be pivotable out of the shoulder support 2 and can then be rotatable, or the swivel arm 50 is a flat iron and is screwed onto the shoulder support 20. The rifle 1 in this way maintains its compact configuration. In the swivel arm 50 a slotted hole 51 is provided into which projects a bolt 52 that is rigidly connected to the breechblock 14. When the swivel arm 50 carries out a swivel movement, this swivel movement is transmitted onto the bolt 52. Since the bolt 52 its rigidly connected to the breechblock 14, the swivel or pivot movement acting on the bolt 52 is transmitted onto the breechblock 14 and the breechblock 14 is moved together with the swivel arm 50 in the respective swivel direction. In the illustrated embodiment, the coupling mechanism has an additional rocking lever 53 by which one or several ejectors 54 are actuated. The lever 53 has a guide onto which the bolt 52 in a lower position of the breechblock 14 causes a tilting movement of the lever 53 by which the ejector 54 is caused to move to the rear. This movement acts onto the cartridges within the barrels 3 so that they are ejected from the barrel 3. In this way, the pivot movement of the swivel arm 50 in the downward direction at the same time causes a cartridge in the barrel 3 to be ejected.

Figure 12:
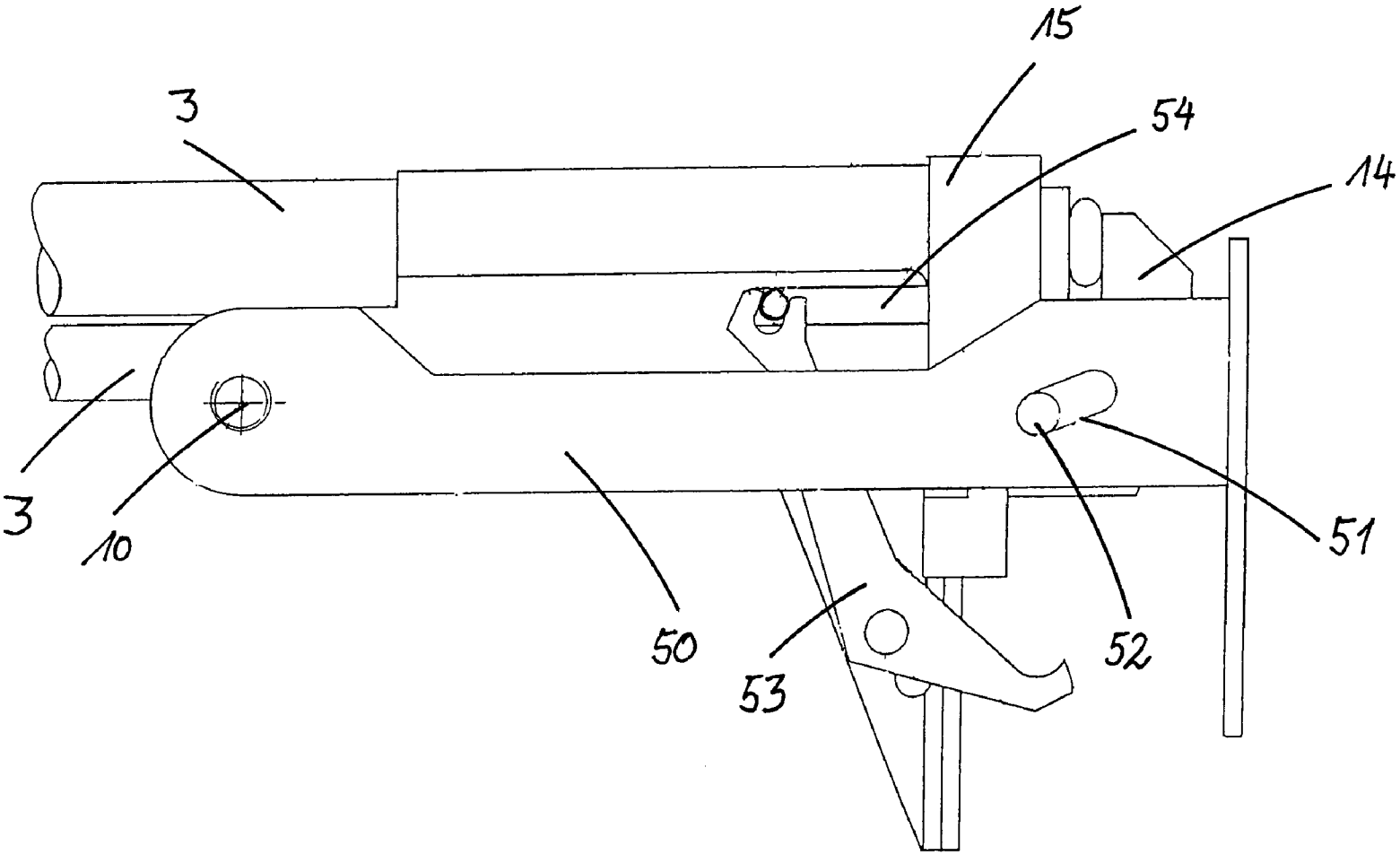
FIG. 12 is a view of the coupling mechanism in a closed position.

In FIG. 12, the coupling mechanism is illustrated in the closed position. The breechblock 14 in this illustration is in a position in which the cartridge chamber 18 is closed. It is easily recognizable that the bolt 52 is now positioned at the opposite end of the slotted hole 51. In the closed position of the breechblock 14 the swivel arm 50 is in a position in which it is approximately parallel to the barrel direction of the barrels 3. Since the swivel arm 50 is advantageously connected to the breechblock housing 15, the explosion forces caused by a shot are therefore introduced straight to the rear into the shoulder of the shooter. In this way, the rifle 1 according to the invention provides an excellent balanced shooting action.

While specific embodiments of the invention have been shown and described in detail to illustrate the inventive principles, it will be understood that the invention may be embodied otherwise without departing from such principles.

What is claimed is:

1. A rifle comprising:

a shoulder support;

two barrels connected to the shoulder support arranged over and under and defining a top barrel and a bottom barrel;

a trigger;

a chamber arranged behind the trigger when looking in a direction from a front end of the barrels toward the shoulder support;

a movable breechblock having a closed position in which the chamber is closed off;

at least one firing pin for firing a cartridge inserted into the chamber when the trigger is triggered;

a coupling mechanism connecting at least one of the shoulder support and a swivel arm to the breechblock, wherein the breechblock is movable by a pivot movement of at least one the shoulder support and the swivel arm transmitted by the coupling mechanism onto the breechblock; and wherein an axis of rotation of at least one of the shoulder support and the swivel arm is arranged within a space delimited by the breechblock and the trigger when viewed across a length of the rifle;

wherein the breechblock comprises a movable block for blocking a transmission of a movement of a trigger bolt of the trigger, caused by triggering the trigger, onto the at least one firing pin.

2. The rifle according to claim 1, wherein the breechblock is a unit closing off the chamber of the two barrels, respectively.

3. The rifle according to claim 1, wherein the trigger comprises a trigger mechanism connected to a frame that is connected to one of the two barrels.

4. The rifle according to claim 3, wherein the frame is connected fixedly to the top barrel or the bottom barrel and has a passage through which the bottom barrel passes when the frame is attached to the top barrel and through which the top barrel passes when the frame is attached to the bottom barrel.

5. The rifle according to claim 1, comprising a switching mechanism with a rocker for alternatingly switching transmission of an action of the trigger onto the at least one firing pin of the top barrel or the bottom barrel.

6. The rifle according to claim 1, comprising a guide for the breechblock.

7. The rifle according to claim 6, wherein a section of the guide where the guide supports the breechblock in the closed position engages the breechblock positively for receiving explosion forces from the barrels.

8. The rifle according to claim 1, wherein the breechblock comprises a mechanism for actuating the at least one firing pin.

9. The rifle according to claim 1, wherein the breechblock is moveable in a direction substantially perpendicular to a longitudinal direction of the barrels.

10. The rifle according to claim 1, wherein, in a firing position of the rifle, the axis of rotation is substantially horizontal and the breech block is moveable in a substantially vertical direction.

11. The rifle according to claim 1, further comprising at least one storage device for ammunition or small parts, wherein the at least one storage device is provided in or on a stock of the rifle or the shoulder support.

12. The rifle according to claim 11, wherein the at least one storage device is detachable.

13. A rifle comprising:

a shoulder support;

at least one barrel connected to the shoulder support;

a trigger;

a chamber arranged behind the trigger when looking in a direction from a front end of the at least one barrel toward the shoulder support;

a movable breechblock having a closed position in which the chamber is closed off;

at least one firing pin for firing a cartridge inserted into the chamber when the trigger is triggered;

a coupling mechanism connecting at least one of the shoulder support and a swivel arm to the breechblock, wherein the breechblock is movable by a pivot movement of at least one the shoulder support and the swivel arm transmitted by the coupling mechanism onto the breechblock;

wherein an axis of rotation of at least one of the shoulder support and the swivel arm is arranged within a space delimited by the breechblock and the trigger when viewed across a length of the rifle;

wherein the trigger is arranged within a central third of a length of the at least one barrel.

14. The rifle according to claim 13, comprising a guide for the breechblock, wherein a section of the guide where the guide supports the breechblock in the closed position engages the breechblock positively for receiving explosion forces from the at least one barrel.

15. The rifle according to claim 13, wherein the breechblock comprises a mechanism for actuating the at least one firing pin and wherein the breechblock is moveable in a direction substantially perpendicular to a longitudinal direction of the at least one barrel.

16. A rifle comprising:

a shoulder support;

at least one barrel connected to the shoulder support;

a trigger;

a chamber arranged behind the trigger when looking in a direction from a front end of the at least one barrel toward the shoulder support;

a movable breechblock having a closed position in which the chamber is closed off;

at least one firing pin for firing a cartridge inserted into the chamber when the trigger is triggered;

a coupling mechanism connecting at least one of the shoulder support and a swivel arm to the breechblock, wherein the breechblock is movable by a pivot movement of at least one the shoulder support and the swivel arm transmitted by the coupling mechanism onto the breechblock;

wherein an axis of rotation of at least one of the shoulder support and the swivel arm is arranged within a space delimited by the breechblock and the trigger when viewed across a length of the rifle;

wherein a triggering movement of the trigger is transmitted onto the at least one firing pin only in the closed position of the breechblock.

17. The rifle according to claim 16, comprising a guide for the breechblock, wherein a section of the guide where the guide supports the breechblock in the closed position engages the breechblock positively for receiving explosion forces from the at least one barrel.

18. The rifle according to claim 16, wherein the breechblock comprises a mechanism for actuating the at least one firing pin and wherein the breechblock is moveable in a direction substantially perpendicular to a longitudinal direction of the at least one barrel.

19. A rifle comprising:

a shoulder support;

at least one barrel connected to the shoulder support;

a trigger;

a chamber arranged behind the trigger when looking in a direction from a front end of the at least one barrel toward the shoulder support;

a movable breechblock having a closed position in which the chamber is closed off;

at least one firing pin for firing a cartridge inserted into the chamber when the trigger is triggered;

a coupling mechanism connecting at least one of the shoulder support and a swivel arm to the breechblock, wherein the breechblock is movable by a pivot movement of at least one the shoulder support and the swivel arm transmitted by the coupling mechanism onto the breechblock;

wherein an axis of rotation of at least one of the shoulder support and the swivel arm is arranged within a space delimited by the breechblock and the trigger when viewed across a length of the rifle;

an ejector, wherein the coupling mechanism comprises coupling elements connected to the ejector such that a swivel movement of the shoulder support causes the ejector to be driven.

20. The rifle according to claim 19, comprising a guide for the breechblock, wherein a section of the guide where the guide supports the breechblock in the closed position engages the breechblock positively for receiving explosion forces from the at least one barrel.

21. The rifle according to claim 19, wherein the breechblock comprises a mechanism for actuating the at least one firing pin and wherein the breechblock is moveable in a direction substantially perpendicular to a longitudinal direction of the at least one barrel.

* * * * *